United States Patent [19]

Mitchell

[11] Patent Number: 4,466,222

[45] Date of Patent: Aug. 21, 1984

[54] DEPRESSION RAIL AND WATER STOP FOR CONCRETE BUILDING SLABS

[76] Inventor: George D. Mitchell, 1012 Wiladona Dr., La Canada, Calif. 91011

[21] Appl. No.: 336,059

[22] Filed: Dec. 31, 1981

[51] Int. Cl.[3] ..... E04F 13/06

[52] U.S. Cl. ..... 52/371; 52/97; 52/174; 52/254; 52/255; 52/678; 404/7

[58] Field of Search ..... 52/365, 366, 371, 97, 52/174, 181, 274, 254, 255, 293, 678, 318, 126.1, 127.2; 404/7, 8

[56] References Cited

U.S. PATENT DOCUMENTS

| | | | |
|---|---|---|---|
| 389,391 | 9/1888 | Landis | 404/7 X |
| 670,001 | 3/1901 | Morss | 404/7 X |
| 1,110,369 | 9/1914 | Bagnell et al. | 52/371 |
| 1,349,340 | 8/1920 | Hotchkiss | 404/7 X |
| 1,789,829 | 1/1931 | Moore | 404/7 |
| 1,881,376 | 10/1932 | Hunter | 404/7 |
| 3,158,962 | 12/1964 | Faase | 52/318 X |
| 3,848,376 | 11/1974 | Elmore | 52/293 X |

FOREIGN PATENT DOCUMENTS

| | | | |
|---|---|---|---|
| 942255 | 11/1963 | United Kingdom | 404/7 |
| 1134262 | 11/1968 | United Kingdom | 52/293 |

*Primary Examiner*—Alfred C. Perham
*Attorney, Agent, or Firm*—Harlan P. Huebner

[57] ABSTRACT

A consumable depression rail and water stop for concrete building slabs wherein the rail when positioned forms a level for the concrete as it is poured and also acts as a guide to form a depressed area of the slab. The elongated rail also forms a water stop to prevent water from moving from the depressed area into a building. The rail is generally T shaped in cross-section, and may be cut into small pieces which are used as consumable supports for maintaining the rail in a fixed position.

4 Claims, 7 Drawing Figures

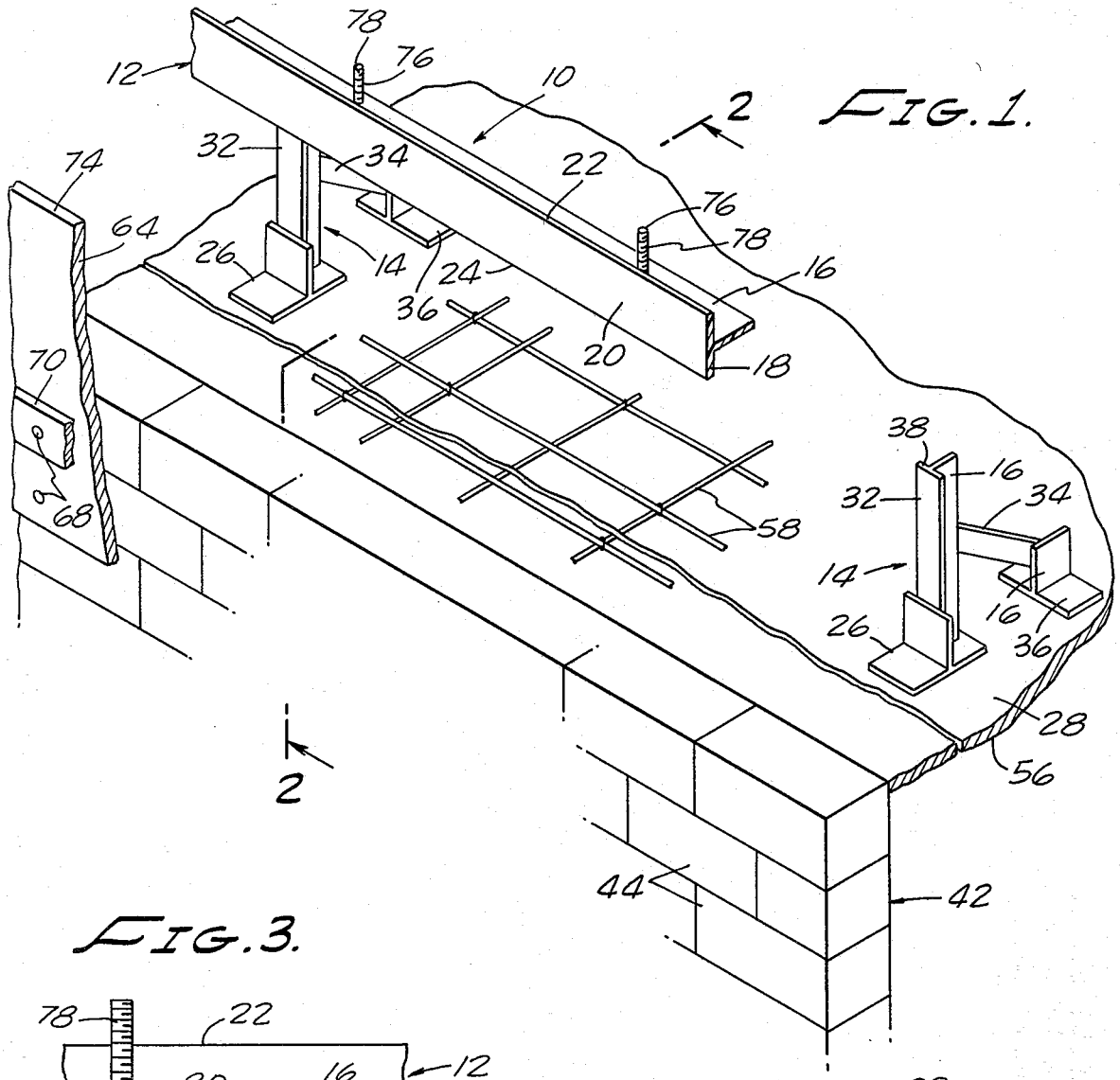
FIG. 1.
FIG. 3.
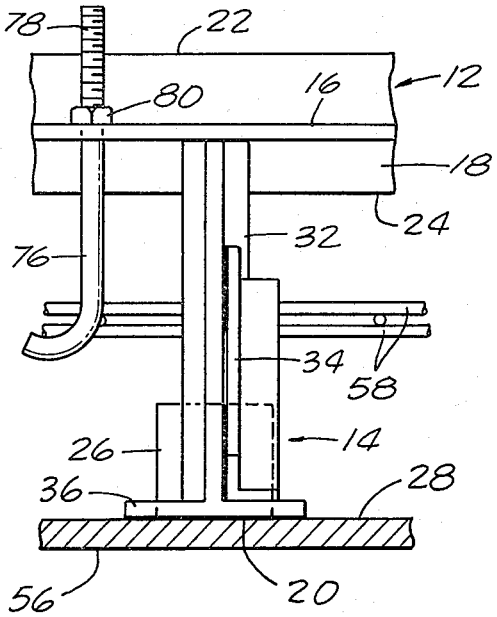
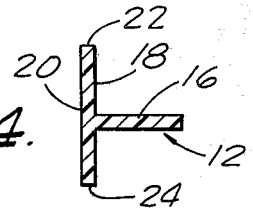
FIG. 4.
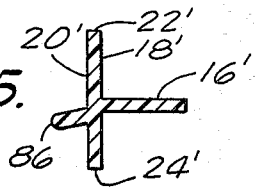
FIG. 5.
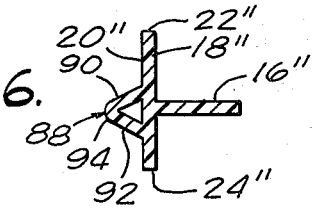
FIG. 6.

DEPRESSION RAIL AND WATER STOP FOR CONCRETE BUILDING SLABS

BACKGROUND OF THE INVENTION

In the construction of apartment buildings, condominums, or other large building structures it is usually desirable, dependant upon the architecture thereof, that there be perimeter areas identified as walkways which extend from the wall of the building to the exterior edge of the building structure.

Such an illustration of a construction of this nature would be that used in an apartment building wherein there is a garage or basement underneath requiring a concrete slab first floor. If the particular building has an exterior walkway then preferably the walkway is depressed or lower than the floor of the building. The purpose of such a depressed area, which normally extends from the exterior wall of the apartment to an exterior edge thereof, is that should rain or moisture from the elements enter the walkway around the building they will not penetrate the actual wall structure on the concrete joining the concrete slab.

In the past in order to form such a depressed walkway it has been necessary to position 2×4's along the peripheral area and stabilizing the horizontally spaced 2×4's to a base piece of wood such as plywood. This has required a great deal of time and effort by the carpenters in order to approximately position the horizontal 2×4's elevated above the base whereby they can use these 2×4's as rails or forms for the concrete.

As the concrete is poured, with regard to the prior art structure, it will move in and around one side normally the interior of the 2×4's creating the interior part of the slab or where the living section is of the building. It will then slide under the 2×4 to a point where it will be of a lesser height than the top of the floor of concrete slab. In the past because of the structure of these wooden frame rails it has been necessary once the concrete has been set to move along the slap and first remove the support means as well as lifting the entire 2×4 or 2×6 from the concrete. It can be readily appreciated that the removal of the supports and wooden rails have necessitated a complete disturbance of the concrete slab in certain places requiring a filling and rescreeding of the material after removed of the wooden forms. In addition the prior art disadvantages have resulted in the fact that before the wooden rail could be removed from the concrete it must set up to the point where the concrete will not flow. Therefore, it can be appreciated that sometimes a great deal of extra expenses are incurred in overtime pay for workers to remain so that the wooden frame members can be removed at just the right time.

Further, as can be appreciated the supports and positioning of the 2×4 rail has commanded a considerable amount of time on the part of the carpenters in nailing the supports to the base and then nailing the 2×4 rails thereto and leving the same as they go.

Finally, when the 2×4 rails are removed there has been no water stop in the concrete that acts as a double protection from the penetration of moisture.

SUMMARY OF THE INVENTION

It is an object of the present invention to provide a depression rail and water stop combination for use in a large area wherein concrete is to be poured to form a concrete building slab.

It is another object of the invention to utilize extruded plastic of a predetermined cross-sectional design whereby an elongated plastic rail may be formed and the material may also be cut into sections and pieces and the sections and pieces united together to form support structures along the surface where the concrete slab is poured. These supports will receive the generally horizontal rail member which rail member will act as both a level and guide for the pouring and final leveling of the concrete but will also remain in place and act as a water stop.

It is another object of this invention to provide a depression rail which is consumable and will remain in the concrete slab upon final pouring of the concrete.

Another object of the invention is to provide a depression rail which is relatively light weight in nature and quickly assembled in position to act as a guide and level during the pouring of concrete in a building structure.

Another object of the invention is to provide a depression rail and waterstop for concrete building slabs wherein the rail can be used as a guide whereby a depressed exterior or perimeter area of the cement slab is lower than the top surface of the finished floor slab whereby the depressed area will form the foundation for an exterior walkway in a building.

A further object of the invention is to provide a depression rail and waterstop formed of extruded plastic material wherein the cross-section is generally T-shaped.

Another object of the invention is to provide a depression rail and waterstop for concrete building slabs which is a relatively inexpensive of manufacture.

Another object of the invention is to provide a depression rail and waterstop for concrete building slabs which does not require the additional time of workers to remove the rail from the concrete slab after the slab is laid and thus eliminating the need for the additional time of workman of removing the same once the slab has been laid and set.

These and other objects will become apparent from the following part of the specification wherein details have been described for the purpose of disclosure, without intending to limit the scope of the invention which is setforth in the appended claims.

BRIEF DESCRIPTION OF THE DRAWINGS

These advantages may be more clearly understood from the following detailed description and by reference to the drawings in which:

FIG. 1 is an environmental prospective view, partly in section, of my invention in place ready for the pouring of concrete to form a concrete building slab;

FIG. 3 is a side elevational view of a portion of the depression rail and waterstop means taken on lines 3—3 of FIG. 2;

FIGS. 4, 5 and 6 are cross-sectional views of the depression rail and water stop of this invention showing modified forms which may be used.

DETAILED DESCRIPTION OF THE PREFERRED EMBODIMENTS

Figure 2:
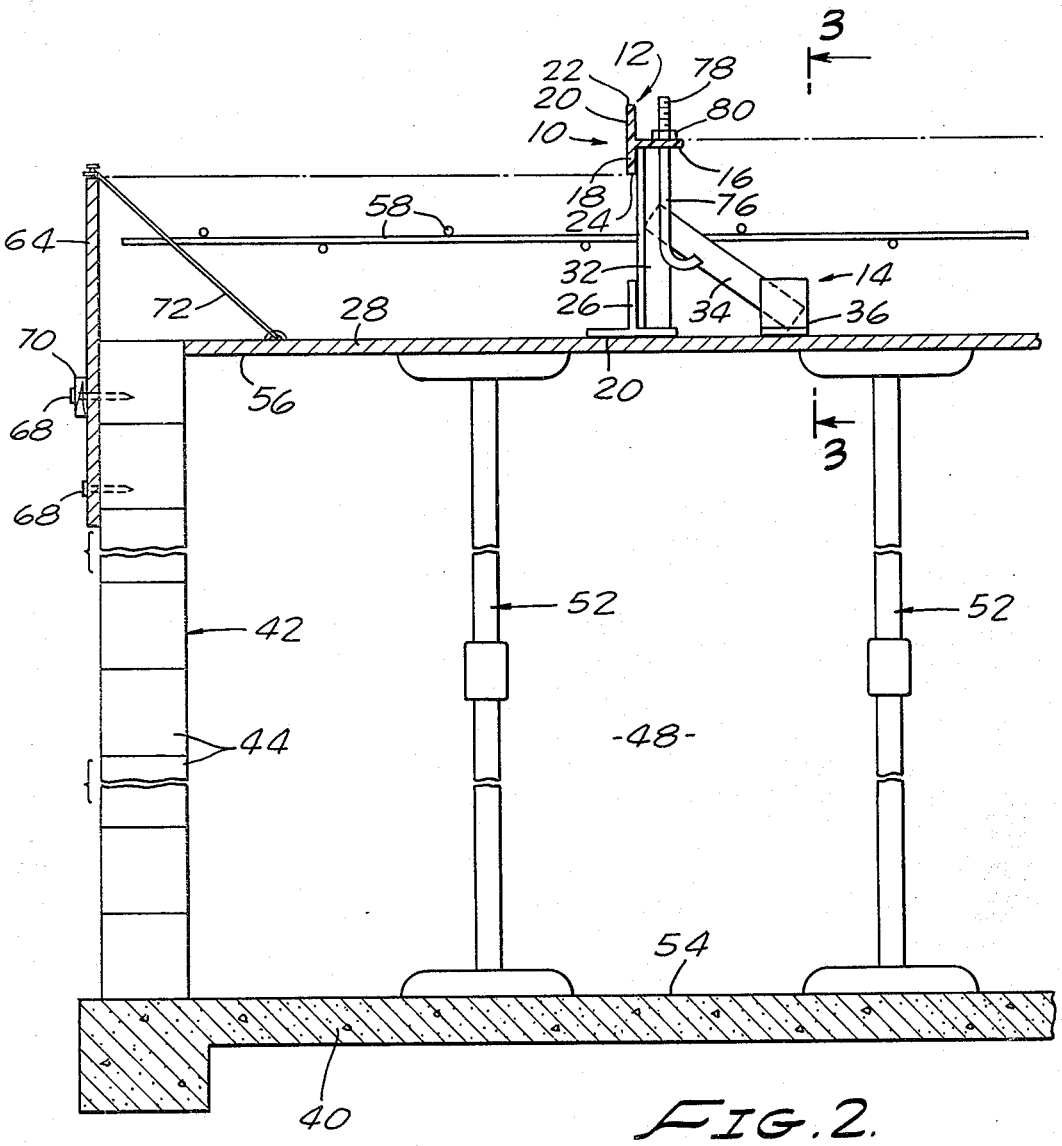
FIG. 2 is a side elevational view, taken on line 2—2 of FIG. 1, partly in section of the form and the depression rail and waterstop of this invention in place preparatory to the pouring of concrete to form a concrete slab.

Now referring specifically to the drawings and particularly in FIGS. 1 and 2 there is illustrated a depression rail water stop means generally designated 10. The depression means 10 includes a generally horizontal elongated guide rail and water stop 12 which is secured to a plurality of vertical support members 14.

One of the advantages of the present invention is that both the elongated rail 12 and vertical support member 14 are formed from the same extruded material. The material is preferably made from extruded A.B.S. or PVC plastic and can be made in varying lengths depended upon which lengths are the easiest to handle and possesses a T-shape in cross section.

Preferably the vertical support members 14 are each cut pieces of an elongated rail 12. In this way the building contractor does not require various pieces of lumber of other materials. All that is required is an elongated generally T-shaped rail material be placed vertically, some small anchor pieces and an appropriate plastic quick setting cement to accomplish the intended results.

The elongated rail member 12 is T-shaped in cross-section such as it is seen in FIGS. 1, 2, 4 and 7. The rail and waterstop 12 includes a leg portion 16 and a top section forming the T which portion extends on either side of the leg 16. The top portion 18 has an outer surface 20. Preferably both the leg and top section 18 are of the same general thickness as can be seen from the majority of the drawings of this application.

Dependent upon the depth of the depression to be formed in a concrete slab the leg portion 16 may be positioned intermediate the respective ends 22 and 24 of the rail 12 or closed to the one end than the other. This may be more fully explained subsequently.

With regard to the vertical support member 14 it can be seen that a piece of the elongated rail 12 has been cut into sections and a respective sections are secured together to form the vertical support.

Preferably the members 14 includes a first base section 26 which may be anywhere from three to four inches in width. The base section 26 is secured by means of quick or fast drying cement applied to the top portion 20 which in turn is glued to and secured to the base form 28 for the concrete building slab 30 as best seen in FIG. 3. A support member 32 is affixed to the base section 26 by means of adhesive affixed to the top portion 20 which in turn is secured to the leg portion 16 as best seen in FIG. 1. This structure, the base 26 and vertical support 32, is further strengthened by means of an angle strut 34 extending from the leg 16 downwardly to a leg portion 16 of a second base section 36. This base section 36 like the base section 26 is secured by quick drying cement means to the base form 28. As can be seen from FIGS. 1 or 2 the angle strut or brace 34 will assure a permanent locked vertical support member 14 as well as vertically align the support member 32.

In preparation for the fixing of the depression rail means 10 generally each of the vertical support members 32 are pre-cut to the same height so that when the rail 12 is positioned thereon it will be in a level condition.

In order to position the rail and waterstop 12 to the vertical support 32, as best seen in FIG. 1, again the top portion 18 on the outer surface 20 of the vertical member 36 has quick drying adhesive applied thereto. The leg section 16 of the horizontal rail 12 is positioned on the top 38 of the vertical support member 32. Also in order to assure that the rail 12 is level a workman can use a level on top thereof and in the event the vertical supports 32 are not all the exact same height the rail can be moved up or down and then affixed to the vertical support 32 to assume a true horizontal level.

While the preferred adhesive is quick drying and does not require considerable effort on behalf of a workman to hold the pieces in place as they are being fixed, it should be noted that clips, not shown and not a part of this invention, may be utilized to maintain the glued members together to assure a setting in the proper height, elevation and alignment necessary.

In the actual laying of the depression rail means 10 the vertical support members 14 are each positioned on the base 28 around the periphery wherein the concrete slab 30 is to be poured. After each of the vertical members 14 are in position then the angle struts and braces 34 are positioned to assure proper alignment. After each of those are in place than the elongated rail and waterstop sections 12 are mounted on the vertical support members 14. When it is necessary to join two of the elongated rail and waterstop sections 12 together they are end butted and a scrap piece of T-shaped material will stradle the abutting ends whereby a continuous rail is created for the entire perimeter or area required for the depression rail and waterstop and the depression portion of the concrete building slab 30.

Generally speaking the concrete building slab 30 forms the base floor or upper flooring of a building such as an apartment house or condominium. In the case of that environmental view illustrated in FIGS. 1 and 2 there is shown a concrete garage or basement floor 40 which around the periphery thereof includes a vertical wall generally designated 42 made up of courses of concrete blocks 44. The wall 42 normally will extend around the perimeter of the structure. At a designated height above the garage floor 40 the base form 28 is positioned. The base form 28 is normally formed of thick plywood and the resultant concrete slab 30 (FIG. 7) formed thereon will actually be the roof or ceiling designated 46 of the garage generally designated 48. The top surface 50 of the slab 30 forms the floor for the apartment or room thereover.

Conventionally, in order to position the base or base forms 28 in position a plurality of jacks generally designated 52 extend between the top surface 54 of the garage floor 40 to the underside 56 of the plywood base form 28. The jack shown is conventional in nature and by means of threaded portions thereof may be moved up and down to assure a level position for the base forms 28.

In view of the fact that the concrete building slab 30 is generally thick there is shown in both FIGS. 1 and 2 conventional type of reenforcing rods 58 which are interlocked and laced together spaced above the base form 28 to impart added strength to the completed slab 30.

Figure 7:
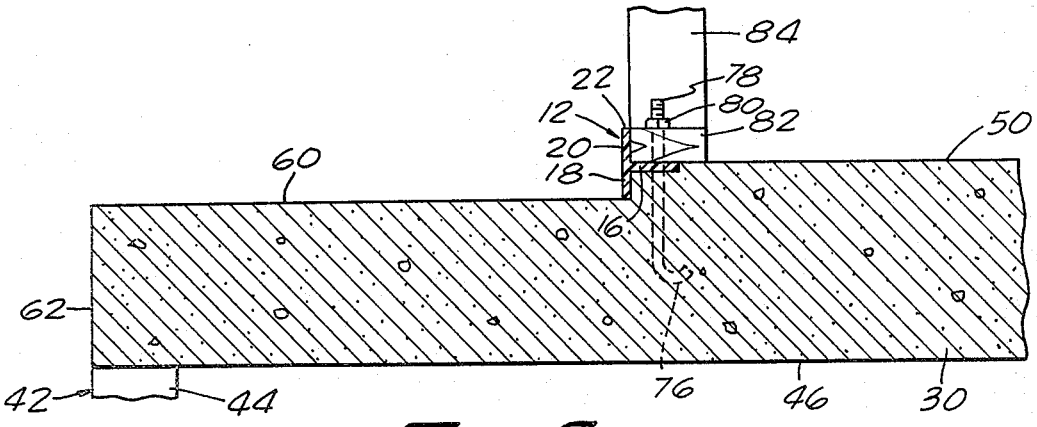
FIG. 7 is a side elevational view of a portion of the completed concrete building slab showing the depressed walkway area thereof together with the wooden base plate in place to receive vertical studs thereon.

In certain building structures the architecture requires outside entrances thereto with walkways or in some cases some of the buildings may have an exterior patio. In view of the fact that the patios or walkways are generally exposed to the elements it is essential that the actual level to the interior floor of the building structure be elevated above the plane of the walk or patio. In this way water is prevented from percolating through the concrete upward into the building structure or the studs or baseplate. Therefore, as can be seen in FIG. 7, the depressed surface generally designated 60 can be seen as stepped down from the top surface 50 of the slab 30. Preferably the depressed surface 60 which forms the walkway or patio is formed to slightly slope away from the building to an exterior edge 62 of the slab 30. In this way there will be the increased possibility of water rolling away from the building and not entering the structure itself.

It is to be recognized that certain building code requirements set forth the drop from the top surface 50 of the concrete building slab to the depressed surface 60. Thus, the location of the leg 16 between the ends of the top portion 18 can be varied to allow for the code required drop.

Normally the wall 42 of concrete blocks 44 terminates at the base form 28 as best seen in FIGS. 1 and 2 and it is necessary to include a peripheral vertical form extending upwardly therefrom to accommodate the concrete which will form the concrete slab 30. To this end there is preferably secured to the exterior of the wall 42 sections of plywood vertical exterior forms 64. The forms 64 are continuous and extend around the entire perimeter of the area wherein the depression 60 is to be formed. The forms 64 may be secured to the exterior of the wall 42 by means of removable concrete spikes 68 which extend through the plywood 64 or may in turn extend through a brace 70 such as from 1×6 piece of lumber. In order to assure complete support against the massive weight of concrete as it is poured, the portion of the form 64 which extends above the surface of the base 28 is tied to the base 28 by means of wire straps 72. A plurality of these straps may be used around the perimeter and will in effect draw the top 74 of the form 64 inwardly to prevent the form from buckling under the weight of the concrete as it is poured.

Once the forms are in position and the depression rails 12 are in position or prior thereto there are inserted through appropriate bores in the leg 16 of the elongated rail 12 conventional anchor bolts 76 having a threaded portion 78. In order to maintain the bolts 76 in position as seen in FIGS. 2 and 3 during the pouring operation a nut 80 is threadably secured thereto with the threaded portion extending at least to the edge 22 of the rail 16.

Once the entire depression rail means 10 is in position, the appropriate forms are positioned around the exterior thereof and the reinforcing rods 58 are placed in position, concrete may then be poured over the entire area to form the slab 30. The leg 16 of the T-shaped rail 12 will normally serve as the guide line for the top surface 50 of the slab 30 whereas the bottom end edge 24 of the top 18 will serve as the guide and edge for the depression or walkway 60. In general construction the concrete is poured within the inside of the rail means 10 and will flow radially outwardly under the depression rail and water stop 12 until it hits the form 64 at the exterior of the building structure. It then backs up inwardly filling the remaining area between or inside of the depression rail means 10. As the concrete is being poured various types of conventional means such as vibrators, etc. may be used to compact and properly distribute the concrete within the forms. After that is accomplished the surfaces may be screeded with trowels etc. and as mentioned before the leg 16 of the elongated rail and water stop 12 will serve as the guide for the smoothing of the top surface 50. The depressed area 60 will be served by the bottom edge 24 of the top 18 so that the concrete worker may smooth the depressed surface 60 outwardly and as mentioned before preferably slopped outwardly from the edge of the end 24 of the T-shaped elongated rail 12 for drainage.

In addition and extremely important is the fact that in the final condition the rail water stop 12 will be permanently embedded in the concrete slab 30. In this way the top 18 and leg 16 of the rail 12 will act as a water stop and prevent any percolation of water thereunder and around the rail into the building structure.

In contradistinction to any of the previous types of conventional wooden rail members used once the concrete has been laid, smoothed and finished, no portion of the depressed rail means is removed. In other words the entire depression rail 10 being relatively small or thin is consumable and it remains embedded in the concrete as best seen in FIG. 7. After the concrete sets the only thing remaining to be done is to remove the exterior form 64 by removing the spikes 68 and cutting the wire straps 72 at the top thereof and then removing the jacks 52 and in turn the plywood base form 28. When this has been accomplished and the concrete slab 30 has dried, then a conventional 2×4 base plate 82, such as seen in FIG. 7, may be drilled and bolted against the leg 16 and concrete slab 30.

The nut 80 which during the pouring of the concrete maintained the anchor bolt 76 from slipping downwardly is now removed and threaded on the threaded portion 78 of the anchor bolt 76 so that the 2×4 basically is cinched in position. Extending upwardly from the 2×4 base plate 82 may be conventional 2×4 vertical studs 84. To the studs 84 conventional plaster board or lath and plaster may be affixed on the inside and outside thereof as well as any other type of siding in order to complete the structure.

In FIGS. 5 and 6 there are illustrated modified cross sectional configurations of the rail and water stop 12. Each of these modifications include the conventional legs 16' and 16'', top portions 18' and 18'' and exterior and top outer surfaces 20' and 20'' of the top portion 18' and 18''.

The modifications reside in the fact that struck outwardly from the outer surfaces 20' and 20'' are in the case of FIG. 5, a short leg section or plaster drip screed 86, the short leg 86 in cross section is angled downwardly and is not normal to the plane of the top portion 18''.

With regard to FIG. 6 there is struck outwardly from the top surface 20'' a short triangle section or plaster drip screed 88 having upper and lower angled walls 90 and 92 which are joined at the appex 94. The purpose of either of these plaster drip screeds 86 and 88 is to act as bottom stops for exterior lath and plaster for a building. Where the plaster drip screed 86 and 88 extend outwardly slightly above the depressed section 60 of the slab 30 it can be seen that there is a further restriction on water percolating from the walkway 60 upwardly behind the plaster.

While the preferred manner of affixing the base 26 and vertical support 32 or rail 10 together is a quick drying adhesive other means may be used. If plastic is the material for the depression rail and water stop means 10 the pieces could be stapled or riveted together. If the material were metal the pieces could be spot-welded.

The invention and its attendant advantages will be understood from the foregoing description and it will be apparent that various changes may be made in the form and method of making, construction and arrangements of the parts without departing from the spirit and scope thereof or sacrificing its material advantages, the arrangements herein before described being merely by way of example. I do not wish to be restricted to the specific forms shown, method, or uses mentioned, except as defined in the accompanying claims, wherein various portions have been separated for clarity of reading and not for emphasis.

I claim:

1. A consumable construction level form and water stop combination for use in laying a concrete slab upon a base wherein the concrete slab has a depressed area below the top surface of said slab, said combination including:

a depression rail and water stop means mounted on said base, said means including a plurality of base support members and a rail water stop extending therebetween and supported thereon and spaced above said base and said base support members and said rail water stop being formed of material each possessing the same cross sectional configuration;

said rail water stop including a first edge horizontal portion that serves as a guide for limiting the height of said top surface of said concrete slab and a second horizontal edge portion spaced vertically below said first edge portion which serves as a guide for limiting the height of said depressed area of said concrete slab;

said depression rail and water stop being of a cross sectional configuration to act as a water stop to prevent moisture on said depressed area from moving onto said top surface of said slab when said depression rail and water stop are fixed in said slab;

each of said base support members include first and second base supports mounted on said base;

a vertical support rising from said first base support;

a strut extending from said second base support to and engaging said vertical support to stabilize said rail and water stop;

said material forming said depression rail and water stop and the pieces of said base supports are T-shaped in cross section and each includes a top portion and a leg extending normal thereto; and said rail and water stop are mounted with the top of said T in a vertical position and the leg of said T extends in a horizontal position inwardly away from said depressed area.

2. A combination as defined in claim 1 wherein each of said base support members include:

the top of said T of said first and second base supports are mounted to said base; and the top of said T of said vertical support faces the outer edge of the area to define said slab and said leg portion extends inwardly; and the top of said T of said strut extends from the leg of the T of said vertical support to the upright leg of the T of said second base member and is permanently affixed to the respective members.

3. A combination as defined in claim 1 wherein said rail and water stop includes:

a plaster drip screed section projecting from said top portion opposite said leg portion.

4. A combination as defined in claim 3 wherein the plane of said plaster drip screed is different from said leg portion.

* * * * *